United States Patent [19]

Balevski et al.

[11] 4,050,503

[45] Sept. 27, 1977

[54] APPARATUS FOR CONTROLLING THE RATE OF FILLING OF CASTING MOLDS

[75] Inventors: Angel Tonchev Balevski; Ivan Dimov Nikolov; Dragan Iliev Nenov; Emil Nikolov Momchilov, all of Sofia, Bulgaria

[73] Assignee: Institute po Metaloznanie i Technologia na Metalite, Sofia, Bulgaria

[21] Appl. No.: 651,691

[22] Filed: Jan. 23, 1976

Related U.S. Application Data

[62] Division of Ser. No. 496,741, Aug. 12, 1974, Pat. No. 3,961,662.

[30] Foreign Application Priority Data

Aug. 16, 1973 Bulgaria ..... 24336

[51] Int. Cl.[2] ..... B22D 17/06; B22D 17/32

[52] U.S. Cl. ..... 164/155; 164/4; 164/119; 164/309

[58] Field of Search ..... 164/4, 154, 155, 151, 164/306, 309, 312, 316, 119, 259, 66, 285

[56] References Cited

U.S. PATENT DOCUMENTS

| | | | |
|---|---|---|---|
| 1,013,548 | 1/1912 | Grey | 164/119 X |
| 2,461,723 | 2/1949 | Cowan | 164/155 X |
| 2,990,592 | 7/1961 | Hursen | 164/155 |
| 3,196,501 | 7/1965 | Balevski et al. | 164/119 |
| 3,302,253 | 2/1967 | Moriyama | 164/155 X |
| 3,302,254 | 2/1967 | Moriyama | 164/155 |
| 3,358,746 | 12/1967 | Crowe | 164/154 X |
| 3,532,154 | 10/1970 | Balevski et al. | 164/155 X |
| 3,768,542 | 10/1973 | Bosworth et al. | 164/155 |

*Primary Examiner*—Ronald J. Shore
*Assistant Examiner*—Gus T. Hampilos
*Attorney, Agent, or Firm*—Karl F. Ross; Herbert Dubno

[57] ABSTRACT

An apparatus for casting a molten material in which the mold is received in one chamber and the molten material is received in another chamber, the two chambers being subject to different pressures so that a tube connecting them can deliver the molten material from the second chamber to the first under a pressure differential. Signal-producing apparatus connected to the mold chambers produce signals representing the two pressures and the pressure differential, the signal-producing apparatus being connected to differentiating apparatus whose output produces time derivatives of the pressures and pressure differential. The time derivatives can be used to control the pressures via a comparator to which a reference value or set point signal is applied thereby varying the rate of filling of the mold in accordance with a predetermined program.

3 Claims, 3 Drawing Figures

APPARATUS FOR CONTROLLING THE RATE OF FILLING OF CASTING MOLDS

This is a division of application 496,741 filed 12 Aug. 74, now U.S. Pat. No. 3,961,662, issued 8 June 1976.

This invention relates to an apparatus for controlling the rate of filling of a casting mold, particularly when this filling or charging takes place under the action of gas pressure.

For simplicity, the molten metal in such systems is usually transferred by the action of a constant difference between the pressure in a hermetically closed chamber containing the melt crucible and in a closed chamber (which is connected with the atmosphere in low-pressure casting) containing the casting mold, the mold being connected with the crucible by a pipe. A desired gas pressure is produced in each chamber: $P_1$ over the melt crucible and $P_2$ in the mold, and the difference $\Delta p$ between them is the transfer pressure. The considerable changes in the conditions of filling the mold, due to the change of the level of the molten metal in the crucible are assumed to be inavoidable or, if their effect on the quality of the castings is inadmissible, they are compensated by a periodic change of the transfer pressure.

Improved systems are known in which the change of the transfer pressure is effected automatically by means of float or other types of level indicators. However, the applicability of these systems is limited by the great difficulty in finding suitabie structural materials to withstand the high temperatures and the action of the molten metal and the slag.

Furthermore, these systems provide, at best a constant velocity of the melt in the runner tube, which is far from being the most favorable for the filling of a particular casting mold, since a constant velocity occasionally results in excessive velocities in the narrow sections and unnecessary low velocities in the large sections of the casting mold.

It is very important, from a technological point of view, to control the rate of filling of the mold according to the shape of the casting, i.e. to select suitable rates of filling the thin and thick areas of the casting, which can be achieved only in special cases by providing contact sensors in the mold itself. This leads to considerable complexity of design and a great increase of the cost of the tool and the control and actuating units.

In the known methods and systems there is no continuous information on the process of filling the mold with molten metal, and, hence, they provide no possibility for a feedback in order to maintain preset process conditions or to vary them with time as may be desirable for a particular casting.

All hitherto known methods and systems for controlling the rate of filling require the casting of a large number of trial castings in order to set experimentally the operating program. This leads to an increase of the cast of the casting process, without, however, providing the necessary precision.

It is an object of the present invention to avoid the drawbacks of the known methods and systems, by providing a simple, sensitive and precise control of the rate of filling of a casting mold, so as to maintain constant and optimum conditioned with all castings and during the process of filling of each individual casting, and thus provide a high and constant quality of castings.

The object of the invention as been achieved by finding a parameter, which permits control of the value of the transfer pressure $\Delta p$ and enables it to be maintained by means of feedback and which by itself reflects automatically to a considerable degree the process of filling the mold.

According to the invention the parameter for controlling the process is the rate of change dp2/dt of the pressure ($P_2$) in the chamber with the mold which is monitored to follow the process. To generate pulses which are fed to the actuating mechanisms we use the jump-like variations of the rate of change $d(\Delta p)/dt$ of the difference $\Delta P$ between the pressures in both chambers when the transfer of the melt takes place as a result of the increase of the pressure P1 in the chamber with the melt crucible, or the rate of variation dp1/dt of the pressure $P_1$ in the chamber with the melt crucible when the transfer of the melt takes place as a result of the decrease of the pressure in the chamber with the mold.

For a better understanding of the invention, reference can be made to the accompanying drawing. In the drawing.

Figure 3:
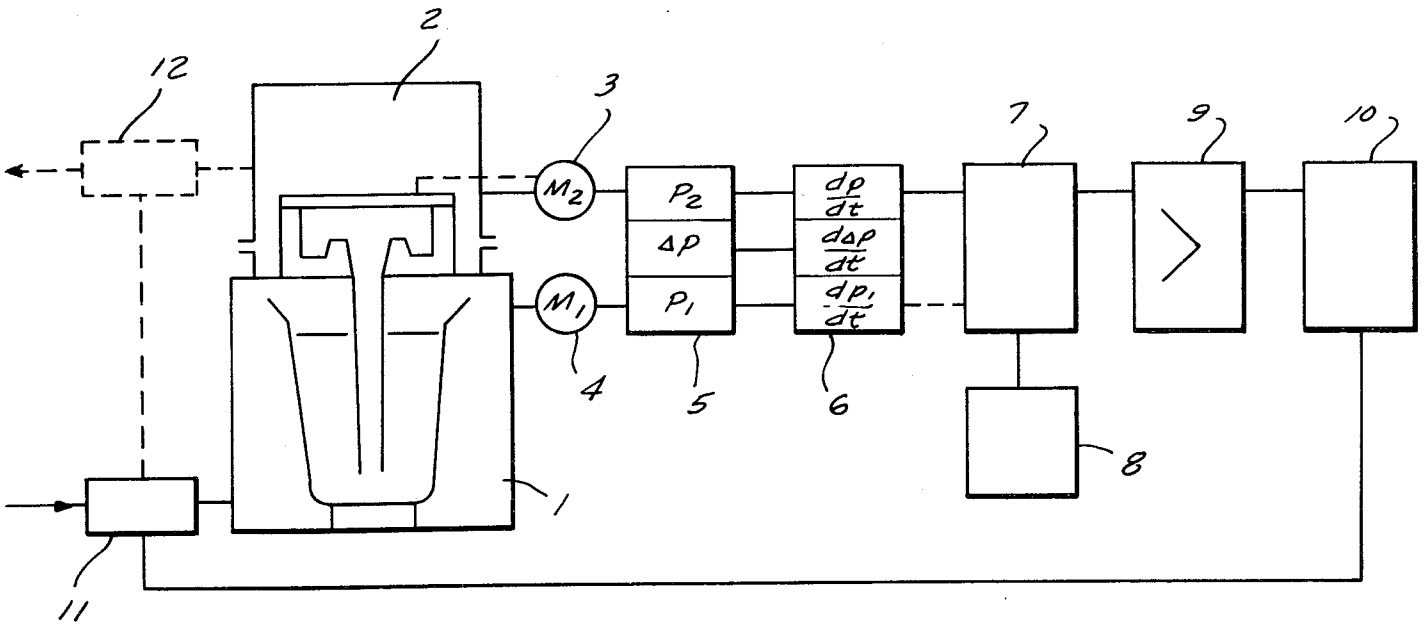
FIG. 3 is a diagrammatic illustration of a casting system of the invention using an electric detection and control system.

In FIG. 3, the solid lines show the operation of the system in producing the transfer pressure differential $\Delta p$ by increasing the pressure in the chamber with the melt crucible, while the broken line shows the case of producing the transfer pressure by reducing the pressure in the casting mold.

Figure 1:
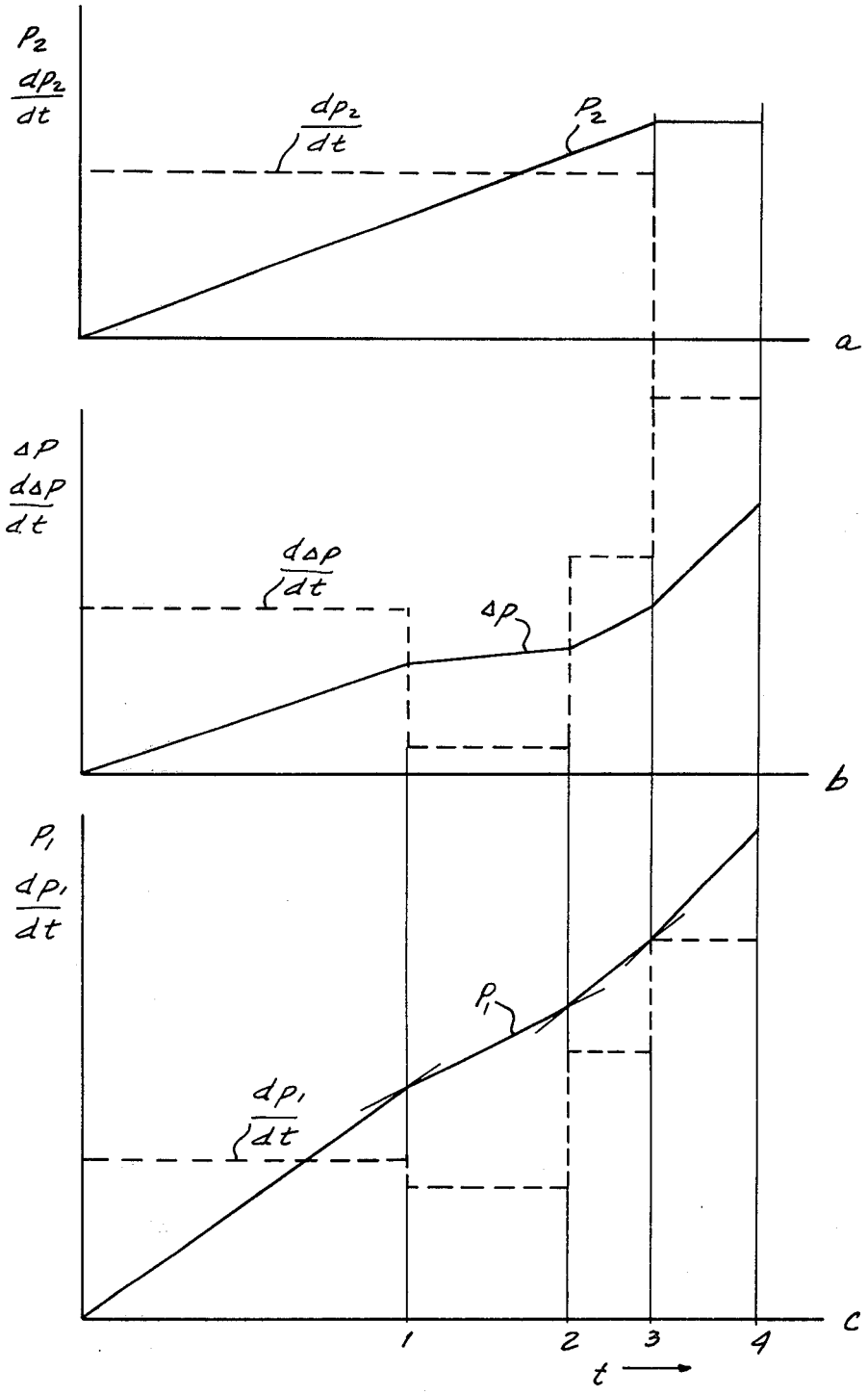
FIG. 1 is a graph of the variation of the gas pressure during the process of casting of a component in the case when the transfer pressure $\Delta p$ is produced by increasing the pressure in the chamber with the melt crucible.

When the mold is to be filled with material at a constant volumetric delivery rate, this will correspond to the variation of the pressure $P_2$ in the chamber with the mold 2 (FIG. 3), shown with a solid line in FIG. 1, resulting from the reduction of the volume of this hermetically closed chamber. From point 3 onwards in this graph the pressure $P_2$ remains constant (graph *a* of FIG. 1), since the mold is filled and the delivery of metal is stopped. To satisfy this condition it is necessary to vary the pressure $P_1$ according to the law illustrated in FIG. 1 (graph *c*) with a solid line, where it is assumed that up to point 1 the metal rises in the runner tube, from point 1 to point 2 it fills a part of the mold which has one shape, from point 2 onward it fills another part of the mold of another shape, and at point 3 the mold is totally filled.

Shown in graph *b* of FIG. 1 with a solid line is the necessary variation of the transfer pressure $\Delta p$, obtained by simple subtraction: $P_2 - P_1$.

Hence, in order to obtain the desired law of filling the mold (the variation of $P_2$ according to graph *d* of FIG. 1) it is necessary to control the throttling valve 11, through which the gas enters the chamber with the crucible 1 (FIG. 3) so as to realize the complex law of variation of $P_1$ according to graph *c* of FIG. 1 or, which is guide is quite the same, of $\Delta p$ according to graph *b* of FIG. 1.

Taking into account, that the straight lines of the graphs are approximated curves and that usually the casting mould is much more complex that the one shown for illustrative purposes, which features only one change of shape, the complexity of the problem becomes obvious.

Shown in the same diagrams (FIG. 1, graphs a,b,c) are also the time derivatives $(dP_2)/(dt)$, $(d\Delta p)/(dt)$ and $(dp_1)/(dt)$. It is seen, that these derivatives undergo jumplike variations at the characteristic moments of the casting process. The derivative $(dP_2)/(dt)$ has a constant value, determining the technologically preset condition for a constant volumetric delivery rate of the metal which fills the mold.

Therefore, it is appropriate to preset, in order to control the process, the parameter $(dP_2)/(dt)$ (in the example a constant), to measure this parameter during the casting process and to maintain the preset character of its variation (e.g. a constant value).

If it is necessary for technological reasons to change at a particular moment of the casting process the delivery rate of the molten metal, then the jump-like variations of $(d\Delta p)/(dt)$ and $(dP_1)/(dt)$ are used as pulses to feed signals to the actuating mechanisms.

These actual-value variations can be recorded by means of electric, pneumatic or hydraulic devices, and after comparison with a preset program (set-print value), the control of the preset technological process can be effected by feedback. Shown as an example in FIG. 3 is the block diagram of an electric system for this purpose.

The first chamber 1, containing the crucible with the molten metal, is connected with the manometer 4, while the second chamber 2, containing the mold, is connected with the manometer 3, which can if desired be connected to the mold cavity instead of with the chamber 2. Both manometers 3 and 4 are also connected with the measuring unit 5, from the output of which signals are fed to the differentiating unit 6, which is connected to the comparing unit 7, and the latter with the presetting unit 8. The signal received from the comparing unit 7 is fed to the amplifier 9, which is connected to the control unit 10, and the latter controls the actuating mechanism or valve 11 or 12.

Figure 2:
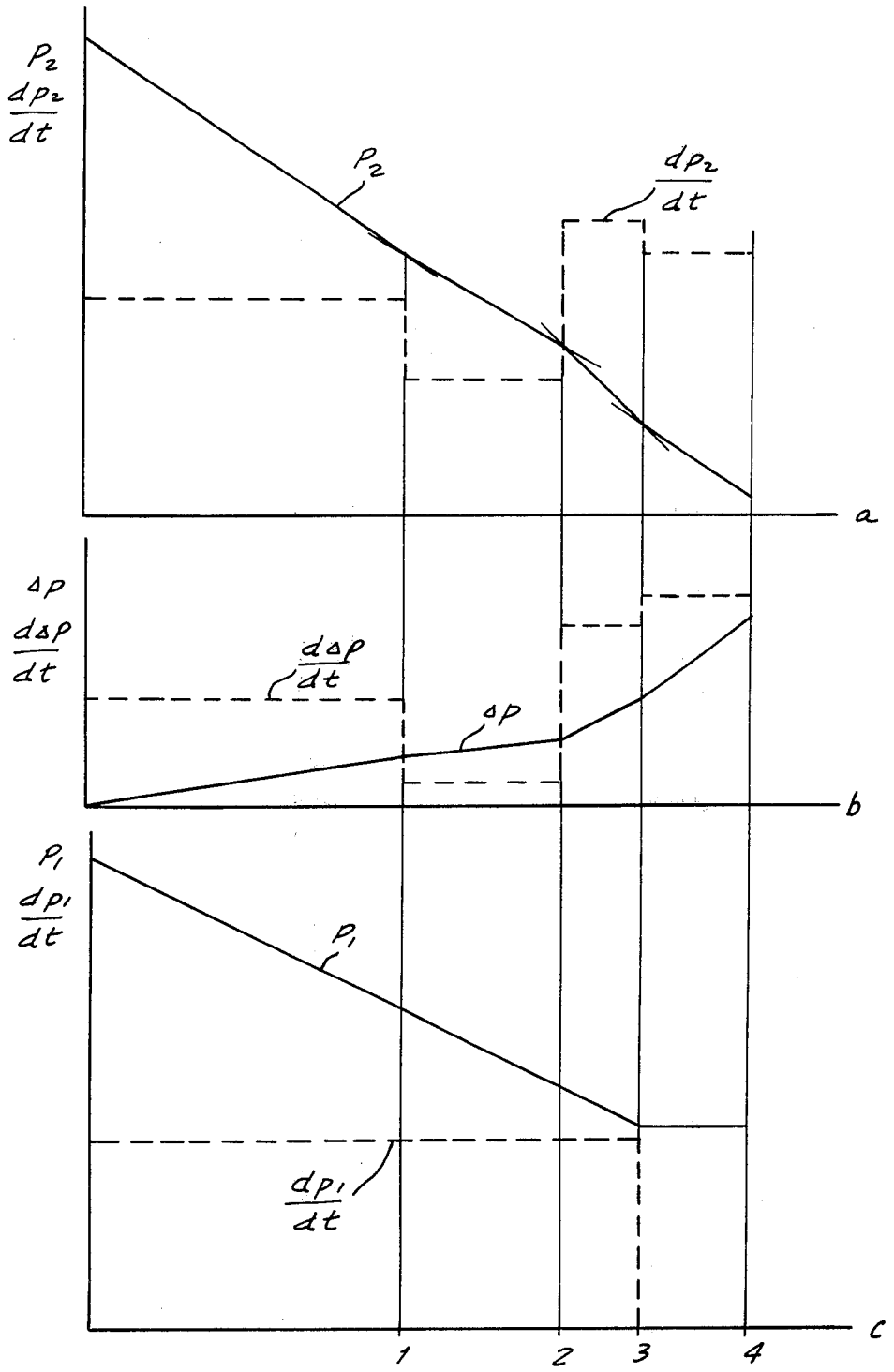
FIG. 2 is an analogous graph for the case when the transfer pressure $\Delta P$ is produced by reducing the pressure in the casting mold.

FIG. 2 shows the variation of the gas pressures $P_2$ (graph a), $P_1$ (graph *c*) and the pressure differential $\Delta p$ in solid lines for the casting of a fluid material when the transfer pressure $\Delta p$ is produced by increasing the pressure in the chamber with the melt crucible relative to the pressure in the mold.

As can be seen from this Figure, the derivative dp1/dt is a constant to the point 3 representing complete filling of the mold while the pressure $P_1$ drops continuously and uniformly, corresponding to the desired constant rate of flow of the molten material into the mold cavity. The other derivatives $dp2/dt$ and $d\Delta p/dt$ show jumps at the various points at which the flow rate must be varied in accordance with a predetermined program to compensate for changes in the flow of material into the mold as previously described.

We claim:

1. Apparatus for controlling the rate of filling of a casting mold, comprising:

a first chamber containing a crucible for the material to be cast and first pressure means operatively associated with the first chamber for supplying a pressure $P_1$ to the crucible;

a second chamber adjacent said first chamber and containing a casting mold and second pressure means operatively associated with the second chamber for supplying a pressure $P_2$ to the mold;

a tube extending between said chambers and connecting said crucible to said mold for conducting said material into said mold at a flow rate determined by the pressure differential $P = P_1 - P_2$; first signal-producing means connected to at least one of said chambers for producing a first signal representing the time derivative of one of said pressures;

monitoring means connected to said signal-producing means for monitoring said first signal and controlling said one of said pressures to maintain the time derivative thereof substantially constant;

second signal-producing means connected to said first signal-producing means for providing a second signal representing the time derivative of one of the parameters constituted by said pressure differential and the other of said pressures;

comparison means connected to said second signal-producing means for comparing said second signal with a set-point value in accordance with a predetermined program; and control means connected to said comparison means for controlling said other pressure in response to a signal representing the comparison of said second signal and said set-point value.

2. An apparatus as defined in claim 1 wherein said second signal-producing means includes means for measuring said pressure differential.

3. An apparatus as defined in claim 1 wherein said second signal producing means includes means responsive to the other of said pressures.

* * * * *